United States Patent [19]

Stambuk

[11] 3,968,900

[45] July 13, 1976

[54] TIMED MEDICANT DISPENSING DEVICE

[76] Inventor: Berigoj K. Stambuk, 655 Camino De Los Mares, Suite 119, San Clemente, Calif. 92672

[22] Filed: July 25, 1975

[21] Appl. No.: 599,169

[52] U.S. Cl. ..... 221/3; 221/15; 221/289

[51] Int. Cl.[2] ..... G04C 23/18

[58] Field of Search ..... 221/3, 15, 92, 289; 116/121

[56] References Cited

UNITED STATES PATENTS

| | | | |
|---|---|---|---|
| 3,395,829 | 8/1968 | Cogdell et al. | 221/15 |
| 3,651,984 | 3/1972 | Redenback | 221/3 |
| 3,815,780 | 6/1974 | Bauer | 221/15 |

*Primary Examiner*—Stanley H. Tollberg
*Assistant Examiner*—David A. Scherbel
*Attorney, Agent, or Firm*—William C. Babcock

[57] ABSTRACT

An electrically operated device capable of holding first and second hollow plastic balls that contain predetermined numbers of tablets or capsules of first and second medicants, and dispensing the balls at timed intervals to a patient. Each ball is defined by interlocking half portions that may be separated to permit the medicant contained in the ball to be removed therefrom. The balls have the medicants placed therein by a pharmacist. The physician supplies the patient with an opaque disk that has at least one ring of circumferentially spaced apertures formed therein. The present invention is illustrated and described as having two rings of apertures in the disk. A clock drive on the device slowly rotates the disk. As the first and second apertures pass first and second beams of light, first and second light sensitive diodes are rendered electrically conductive to energize first and second solenoid operated dispensers that allow first and second balls to roll onto a spring loaded pivotally supported dispenser tray from which the balls may be taken by the patient. The first and second balls may be dispensed either concurrently or at different time intervals. The dispensed balls, as they pivot the hinged tray to a supporting position, completes an electric circuit to an electrically operated alarm to audibly notify the patient to remove the balls from the tray. The audible alarm will continue to operate until the dispensed ball or balls are removed from the tray. After a ball has been dispensed onto the dispenser tray and until the ball is removed therefrom, the clock drive is de-energized, and as a result a patient cannot take the medicant oftener than the time intervals dictated by the spaced apertures formed in the disk.

7 Claims, 12 Drawing Figures

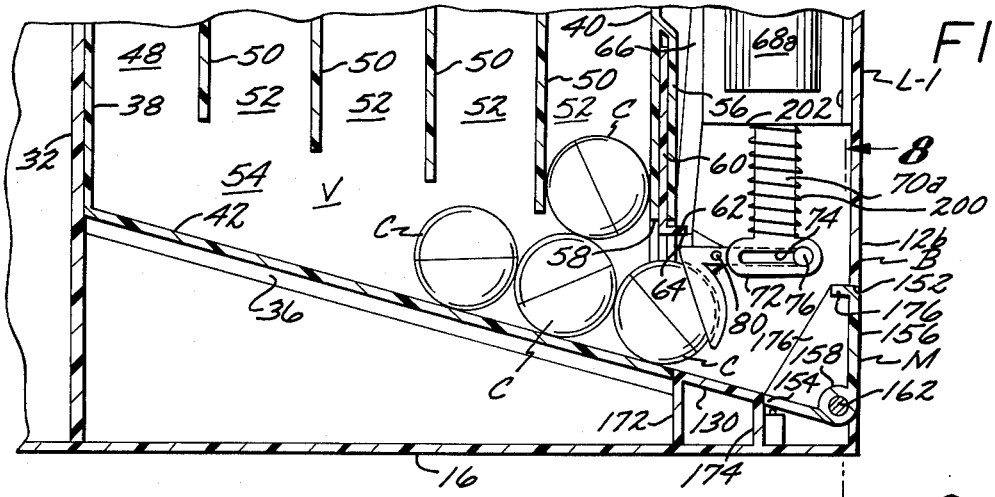
FIG. 6
FIG. 7
FIG. 8
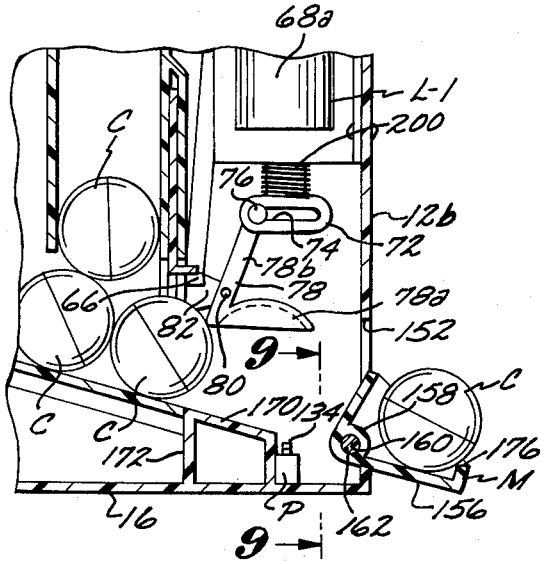
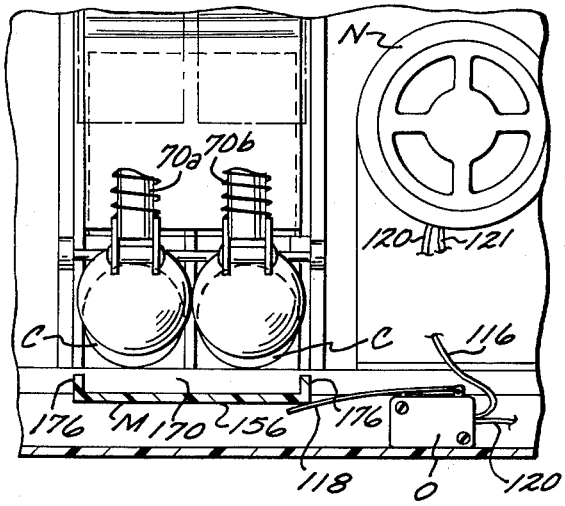
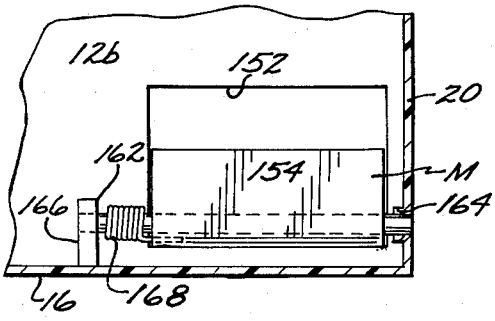
FIG. 9
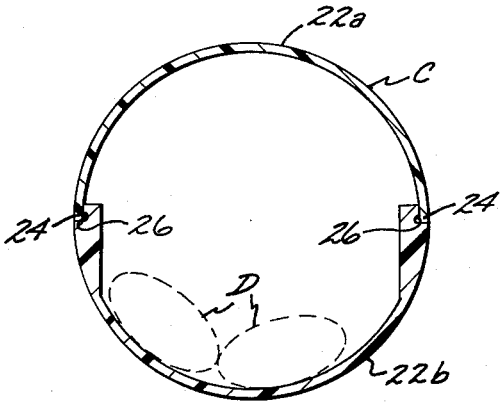
FIG. 10

TIMED MEDICANT DISPENSING DEVICE

BACKGROUND OF THE INVENTION

1. Field of the Invention

Timed medicant dispensing device.

2. Description of the Prior Art

In the treatment of certain patients, it is necessary that they take prescribed medicants at timed intervals.

A major object of the present invention is to supply an electrically operated device in which the medicant in prescribed quantities is disposed within hollow plastic balls that serve as carriers therefor, with the balls being consecutively dispensed to the patients at timed intervals, and each dispensing of the ball being accompanied by the generation of an audible signal to remind the patient to take the medicant.

Another object of the invention is to provide the dispensing of a medicant by use of an opaque disk in which circumferentially spaced apertures are formed therein under the direction of the prescribing physician, and the spacing between the apertures determining the time intervals at which the medicant is dispensed as the disk is slowly rotated by an electrically driven timer mechanism.

A still further object of the invention is to furnish a device in which either a single medicant or a number of different medicants may be dispensed at timed intervals, and the timed intervals not necessarily being equal, but of such magnitude as the prescribing physician may desire.

A still further object of the invention is to supply the medicant to the patient in a clean and sanitary condition as each dose of the medicant until just prior to use is contained within a hollow plastic ball, which ball is defined by two interlocking halves that may be easily separated by the patient to remove the medicant therefrom.

Another object of the invention is to supply a medicant dispensing device in which the medicant is dispensed to the patient at desired time intervals and at each dispensing an audible alarm being generated that continues until the patient removes the medicant from the pivotally supported tray into which it is dispensed.

SUMMARY OF THE INVENTION

The device includes a hollow housing in which a number of hollow plastic medicant containing balls are stored in adjacent columns, and the lowermost balls in each column resting on a downwardly inclined ramp. The positioning of the balls in the housing is preferably by a removable cannister, that is easily inserted in the housing.

An electrically driven timer forms a part of the device and rotates an opaque disk in which a number of circumferentially spaced apertures are formed. The timer rotates the disk at a constant rate, and accordingly the circumferential spacing between two adjoining apertures determines the time interval between the dispensing of doses of the medicant.

When the timer rotates the disk to dispose one of the apertures in a predetermined position, a light beam may pass through the aperture to actuate an electric circuit and associated components to dispense one of the medicant containing balls, and to concurrently energize an audible electric alarm to signal to the patient that it is time to take the medicant. The alarm continues to operate until the patient removes the medicant from the device. When a dispensing operation takes place, the timer stops until the medicant is removed from the device by the patient, and thus insures that the patient will not take the medicant oftener than the time interval prescribed by the physician.

The medicant is dispensed to the patient in hollow balls that are formed from interlocking halves and the medicant, prior to being taken, being maintained in a clean and sanitary condition. The device is adapted to be used not only in dispensing a single medicant, but any desired number of different medicants to a patient and at any desired number of timed intervals.

BRIEF DESCRIPTION OF THE DRAWINGS

FIG. 6 is a fragmentary longitudinal cross sectional view of the device prior to a ball dispensing operation;

FIG. 7 is the same view as shown in FIG. 6, but after one of the medicant containing balls has been dispensed therefrom onto a pivotally supported dispenser tray;

FIG. 8 is a fragmentary transverse cross sectional view of the device taken on the line 8—8 of FIG. 6;

FIG. 9 is a fragmentary transverse cross sectional view of the device taken on the line 9—9 of FIG. 7;

FIG. 10 is a transverse cross sectional view of one of the medicant containing balls illustrating the manner in which two halves of the ball removably interlock to one another;

DESCRIPTION OF THE PREFERRED EMBODIMENT

Figure 1:
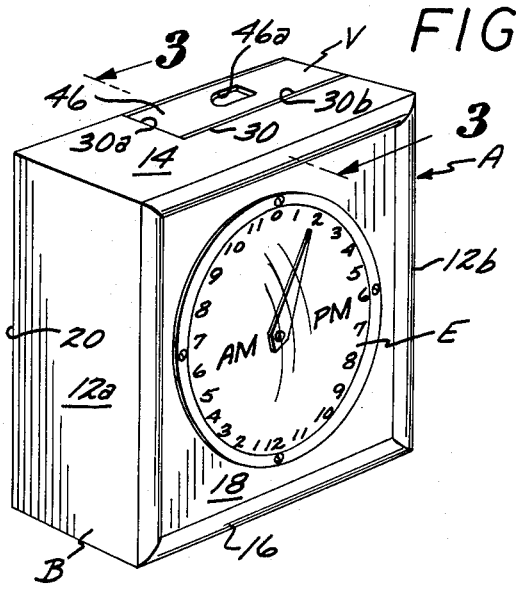
FIG. 1 is a perspective view of the timed medicant dispensing device.

The timed medicant dispensing device A as illustrated in the drawings, includes a housing B in which two groups of hollow plastic balls C are stored in a removable cannister V. As the invention A is illustrated and described it is adapted to selectively dispense both first and second medicants D, with each medicant contained in a separate ball C. However, if desired, any number of medicants may be contained within a single ball C. The device A may be used for dispensing but a single medicant if desired. Likewise, by modifying the cannister V, any desired number of groups of balls C may be contained therein to be selectively dispensed when the invention A is of a structure to handle this number of groups of balls C.

Figure 4:
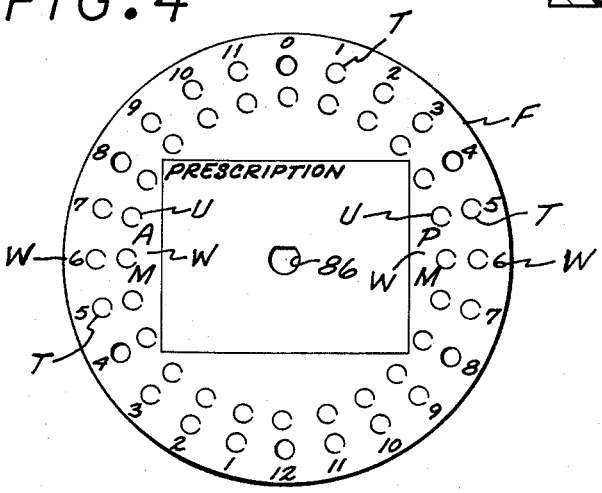
FIG. 4 is a front elevational view of an opaque disk in which a number of circumferentially spaced apertures are formed to control the timed dispensing of both first and second medicants.

The device A includes an electrically driven timer E that slowly rotates an opaque disk F. The disk F is illustrated as having first and second rings of apertures T and U. The first apertures T are circumferentially spaced from one another and equally spaced from the center of the disk F. Second apertures U are also circumferentially spaced from one another in the disk F, but are spaced from the center of the disk a distance less than the first apertures T as may be seen in FIG. 4.

Figures 11, 12:
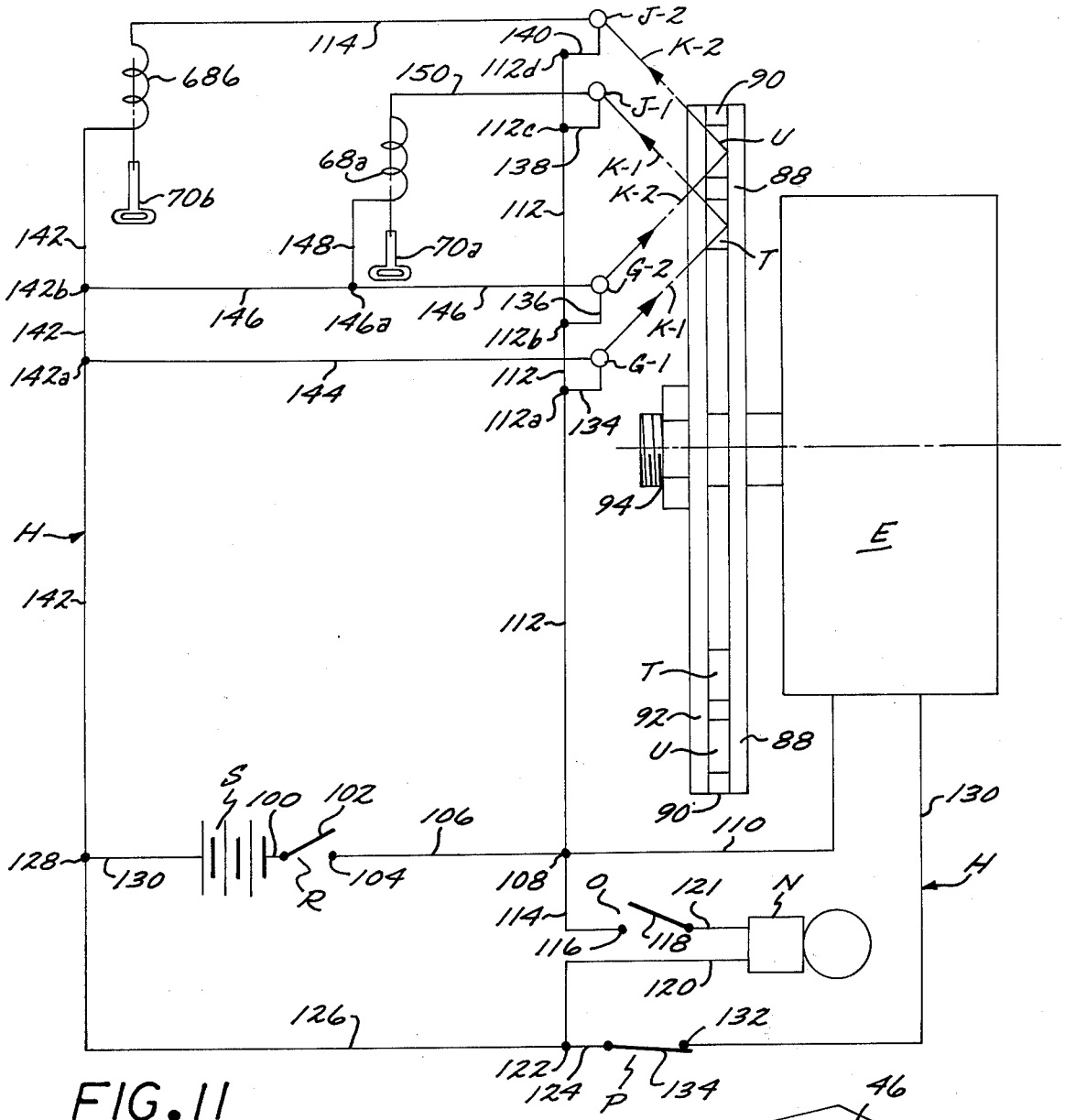
FIG. 11 is a diagrammatic view of the electric circuit used in conjunction with the invention.
FIG. 12 is a perspective view of a cannister in which the balls are stored, with the cannister capable of being inserted in the dispensing device.

First and second light emitting diodes G-1 and G-2 are provided that form a part of an electric circuit H as may be seen in FIG. 11, which circuit is supplied electric power from a source S. The source S may be either a battery or domestic electricity. The circuit H also includes first and second light sensitive diodes J-1 and J-2 that are electrically conductive only when a beam of light impinges thereon.

During the operation of the device A the diodes G-1 and G-2 emit first and second beams of light K-1 and K-2 that impinge on the light sensitive diodes J-1 and J-2 only when the first and second apertures T and U in the disk F occupy predetermined positions relative to the beams of light.

When the first and second apertures T and U are so disposed, the electric circuit H is completed to actuate first and second solenoid operated mechanisms L-1 and L-2 either together or at timed intervals relative to one another as may be seen in FIG. 11 to allow balls C containing first and second medicants D to roll by gravity on to a spring loaded, pivotally supported dispenser tray M. The dispenser tray M is shown in a dispensing position in FIG. 7.

The device A is placed in an operating condition by closing a first electrical switch R that forms a part of circuit L, which switch is shown in FIG. 11.

As the dispenser tray M pivots from a first to a second ball C dispensing position as shown in FIGS. 6 and 7, a second switch O that forms a part of electric circuit H is closed to energize an electric alarm N, which alarm continues to operate until the balls C resting on the dispenser tray M are removed therefrom. The balls C, upon being removed from the dispenser tray M, allows the latter to pivot to the first position shown in FIG. 6. This pivotal movement of the dispenser tray M from the first to the second position is accomplished automatically by spring means associated with the dispenser tray as shown in FIG. 9.

The pivoting of the dispenser tray M to the second position shown in FIG. 7, results in the opening of a normally closed third switch P in the electric circuit H, which results in the timer E ceasing to be supplied with electricity to operate from the source S.

The third switch P which is spring loaded automatically returns to a closed position to energize timer E when the dispenser tray M pivots from the second position shown in FIG. 7 to the first position illustrated in FIG. 6. The completion of the electric circuit H by beams of light K-1 and K-2 impinging on light sensitive diodes J-1 and J-2 results in the first and second solenoid operated mechanism L-1 and L-2 being electrically energized to dispense balls C onto the pivotally supported dispenser tray M as will later be explained in detail.

The housing B, in detail as may be seen in the drawings, includes first and second side walls 12*a* and 12*b*, a top 14, and a bottom 16. Housing B also includes a front wall 18, that removably supports a conventional electrically operated timer T, and a back wall 20. Each of the medicant containing balls C is preferably formed from a resilient plastic and includes first and second half portions 22*a* and 22*b* that by circumferentially extending tongue and groove structures 24 and 26 as shown in FIG. 10 are removably locked together. When the balls have the half portion 22*a* and 22*b* locked together they are capable of holding a prescribed quantity of the medicant D shown in phantom line in FIG. 10. The top 14 of housing A as may be seen in FIG. 1 has an opening 30 formed therein that is defined by end edge 30*a* and side edge 30*b*.

The opening 30 permits the cannister V to be removably inserted within the interior of the housing A. The housing A includes a first transverse partition 32 as may be seen in FIG. 6 and a second longitudinally extending partition 34 illustrated in FIG. 3. A pair of parallel, laterally spaced, downwardly sloping supports 36 are secured to the interior surfaces of the back wall 20 and second partition 34.

The ball containing cannister V as may be seen in FIG. 12 is preferably formed from a plastic material and includes a first end wall 38, second end wall 40 and a bottom 42 that is inclined and serves as an inclined ramp for the balls C contained in the cannister V to rest on as may be seen in FIG. 6.

Figure 3:
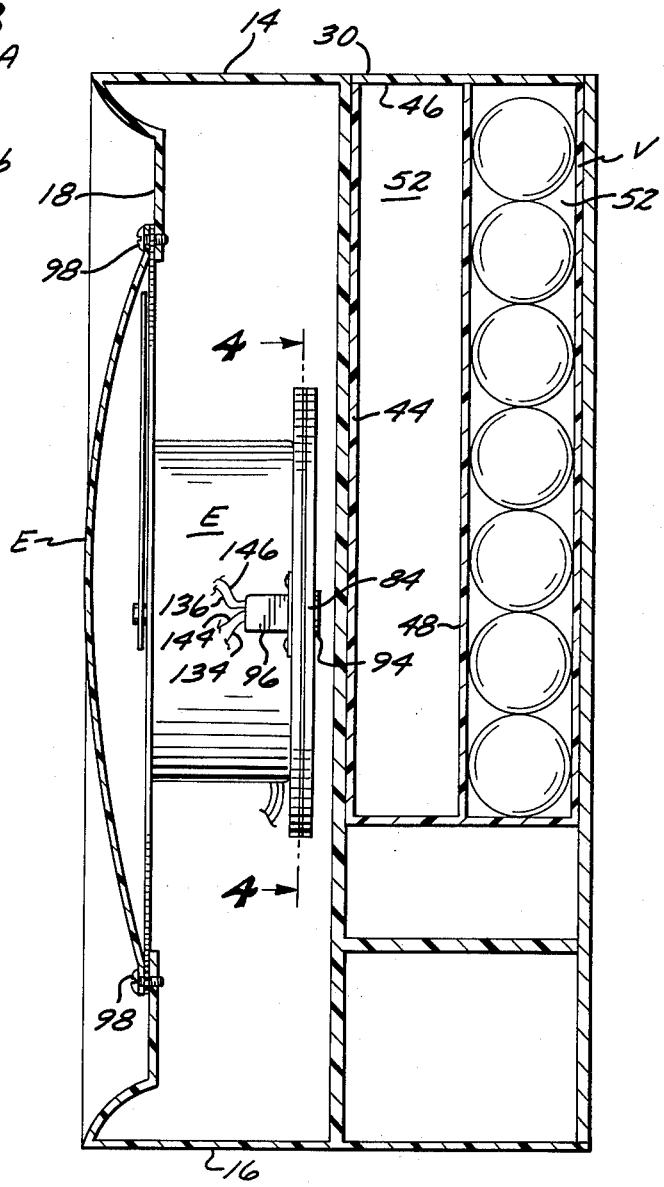
FIG. 3 is a transverse cross sectional view of the device taken on the line 3—3 of FIG. 1.

The cannister V also includes a pair of laterallly spaced side walls 44 and a top 46. Top 46 has a finger engageable opening 46*a* therein to permit the cannister to be lifted out of housing B. The cannister V also includes an intermediate partition 48 shown in FIG. 3 that is situated between the side walls 44, and in addition a number of longitudinally spaced transverse partitions 50 are provided as also may be shown in FIG. 6 that terminate above the ramp defining bottom 42 a distance greater than the diameter of the balls C. This spacing of the partitions permits the balls C to roll downwardly on the bottom 42 as shown in FIGS. 6 and 7 towards the side wall 12*b*. The partitions 50, together with the intermediately disposed partition 48 cooperate to define a number of vertically extending confined spaces 52 in which the balls C may be stored as shown in FIG. 3, and the stored balls C at all times being in communication with a longitudinally extending space 54 shown in FIG. 6 above bottom 42. Second end wall 40 of the cannister V has a bifurcated end portion 56 formed therein as shown in FIG. 6 that is disposed above an opening 58 formed in the second end wall 40. A door 60 is slidably movable in the bifurcated end portion 56, and the door when in a first position obstructs the opening 58 to prevent balls C rolling therethrough prior to the cannister V being placed in the dispenser A. The door 60 is automatically slid from a first closed position to the second position illlustrated in FIG. 6 when the cannister V is inserted within the housing A and moved downwardly relative thereto. As such downward movement takes place a lip 62 on the door contacts shoulders 64 formed on vertically extending ribs 66 secured to the interior surfaces of the back wall 20 and second partition 34. The cannister V now moves downwardly relative to the door 60, and the door when disposed as shown in FIG. 6 permitting balls C to roll through opening 58.

The first and second solenoid operated mechanisms L-1 and L-2 include first and second solenoid coils 68*a* and 68*b* that are illustrated in FIG. 11. The first and second solenoid coil 68*a* and 68*b* have first and second elongate magnetically attractable armatures 70*a* and 70*b* slidably and longitudinally movable therein, which armatures are shown in FIG. 8. Each of the armatures 70*a* and 70*b* have a cross piece 72 secured to the lower end thereof. Each cross piece 72 has a longitudinal slot 74 formed therein. Each of the longitudinal slots 74 is slidably engaged by a pin 76. Two pairs of L-shaped ball stops 78 are provided, with each stop including a first convex-concave leg 78*a*, and a second leg 78*b* as may best be seen in FIG. 7. Each second leg 78*b* is secured to one of the pins 76. The pair of L-shaped ball stops 78 are longitudinally aligned with the pair of sets of confined spaces 52 and pair of longitudinal spaces 54, one of which sets is shown in FIG. 6. The pair of ball stops 78 are pivotally supported on a transverse shaft 80 that is held in a fixed position within the housing B by a pair of brackets 82 shown in FIG. 7.

Figure 5:
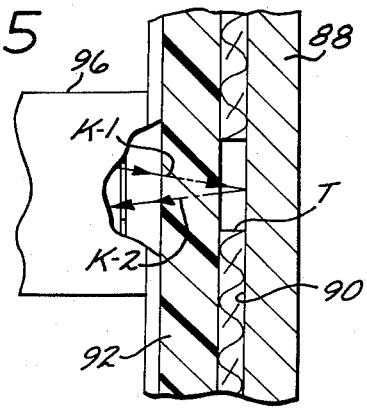
FIG. 5 is an enlarged front elevational view of the optical electrical control, and a sectional view of one of the apertured disks and means for rotatably supporting the latter.

The timer E includes a drive shaft 84 that has a flat longitudinally extending surface thereon, and a centered opening 86 is formed in the disc F of such configuration as to slidably but non-rotatably engage the drive shaft. The disc F is sandwiched between a rigid disk 88 having a light reflecting surface 90 and a transparent disk 92, each of which disks have centered openings formed therein of the same shape as the opening 86. The disk F, rigid disk 88, and transparent disk 92 are held together and in abutting contact as a unit as shown in FIG. 5 by a nut 94 that engages a threaded portion of the drive shaft 84.

The light emitting diodes G-1 and G-2 and light sensitiive diodes J-1 and J-2 are preferably supported in an opaque container 96 that, by conventional means (not shown) in housing B is held at a fixed position relative to the timer E. When the disk F is rotated to a position where one of the apertures T or U is aligned with one of the beams of light K-1 or K-2, the light beam will pass through the aligned aperture to impinge on the light reflecting surface 90 and be reflected back through the transparent disk 92 to the light sensitive diodes J-1 or J-2 to render the latter electrically conductive. The disk F is formed from a non-light reflecting sheet material. The disk F has printing W thereon that indicates A.M. and P.M. and the 12 hours in each of the latter. In FIG. 5 it will be seen that a light beam K-1 is passing through one of the apertures T to be reflected from the surface 90 as above described. The same result is achieved when one of the apertures U is so aligned with the second light emitting diode G-2 as for a beam K-2 of light to be reflected from the surface 90 to the light sensitive diode J-2.

The timer E is removably secured to the front wall 18 of the housing B by screws 98 or other conventional means, to permit the timer to be removed from the housing for a disk F to be mounted on the timer drive shaft 84 or removed therefrom.

The electric circuit H includes the following components. One terminal of the source of electricity S is connected by an electric conductor 100 to a blade 102 of a first switch R, which switch includes a contact 104 that may be engaged by the blade. When the blade 102 is in engagement with the contact 104 the electric circuit H is energized. Contact 104 is connected by an electric conductor 106 to a junction point 108, from which junction point conductors 110, 112 and 114 extend. The conductor 114 extends to a contact 116 that may be engaged by the blade 118 of a second switch O, which is of the spring loaded type, and normally occupies an open position. The blade 118 is connected by a conductor 121 to one terminal of the electric alarm N, with the other terminal of the alarm being connected by a conductor 120 to a junction point 122 from which two conductors 124 and 126 extend. The conductor 126 is connected to a junction point 128 from which a conductor 130 extends to the second terminal of the source of electricity S. One terminal of timer E is connected to conductor 110 and the other terminal is connected by a conductor 130 to a contact 132 that forms a part of a third switch P, which switch is of the spring loaded type, and normally occupies a closed position.

The third switch P includes a blade 134 that may engage the contact 132 and is connected to conductor 124 as shown in FIG. 11. Conductor 112 includes junction points 112*a*, 112*b*, 112*c* and 112*d*. Junction points 112*a* and 112*b* are connected by conductors 136 and 138 to terminals of the light emitting diodes G-1 and G-2.

Junction point 112*c* and 112*d* are connected by conductors 138 and 140 to terminals of the light sensitive diodes J-1 and J-2. A conductor 142 extends from junction point 128 to a second terminal of the second solenoid 68*b*. Junction point 142*a* is connected by a conductor 144 to a second terminal of the light emitting diode G-1. A conductor 146 connects junction point 142*b* to the second terminal of the second light emitting diode G-2. Conductor 146 has a junction point 146*a* therein from which a conductor 148 extends to one terminal of the first solenoid 68*a* as shown in FIG. 11. The opposite terminal of the first solenoid 68*a* is connected by a conductor 150 to a terminal of the first light sensitive diode J-1.

Figure 2:
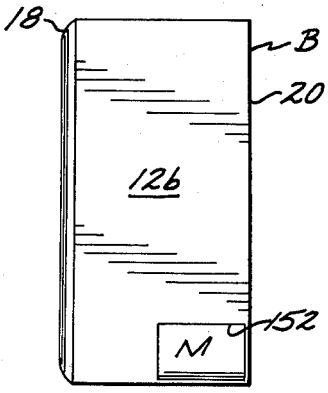
FIG. 2 is an end elevational view of the device.

The ball dispenser tray M as may be seen in FIG. 6 normally occupies a first position shown in FIG. 6 and closes an opening 152 formed in the end wall 12*b*. The opening 152 is also shown in FIGS. 2 and 7. The ball dispenser tray M is of generally transverse L-shaped cross section and includes a first leg 154 and second leg 156. The first and second legs 154 and 156, at their junction, define a second portion 158 through which a bore 160 extends. The bore 160 serves to pivotally support the ball receiving tray M on a shaft 162 that has the ends thereof secured in a non-rotatable position by a support 164 secured to the back wall 20 and a second support 166 that extends upwardly from the bottom 16. The supports 164 and 166 are shown in FIG. 9.

A very light helical spring 168 encircles the shaft 162 as may be seen in FIG. 9, and has one end secured to the shaft 162 and the other end to the ball dispenser tray M. The spring 168 at all times tends to hold the ball dispenser tray M in the first position shown in FIG. 6. When the ball dispenser tray M is in the first position shown in FIG. 6, the first leg 154 thereof is in alignment with an extension 170 of the ramp defining bottom 42, to permit one of the balls C to roll by gravity from the bottom 42 over the extension 170 onto the first leg 154 of the ball receiving tray M. The extension 170 is supported in a fixed position in the housing C by two legs 172 and 174 that extend upwardly from the bottom 16 as shown in FIG. 7.

The second leg 156 of the ball dispenser tray M has walls 176 extending upwardly from opposite sides thereof as well as from the free end of the second leg to prevent a ball C rolling therefrom when a ball is positioned as shown in FIG. 7.

The ball dispensing device A is placed in an operating position by closing the first switch R. Closing the first switch R as may be seen in FIG. 11 results in an electric current flowing from a first terminal of the source F through a conductor 100, blade 102, contact 104, conductor 106, conductor 108, conductor 112, junction point 112*a*, conductor 134 to a light emitting diode G-1. The first light emitting diode G-1 also has a conductor 144 connected thereto that extends to a junction point 142*a*, and a conductor 142 extends from junction point 142*a*, and a conductor 142 extends from junction point 142*a* to junction point 128. Junction point 128 is connected by a conductor 130 to the second terminal of the source of electric power F. From the wiring diagrams shown in FIG. 11 it will be apparent that the second light emitting diode G-2 is concurrently energized with the first light emitting diode G-1.

The closing of the first switch R establishes an electric circuit to the timer E through conductor 100, blade 102, contact 104, conductor 106, junction point 108, conductor 110, conductor 130, contact 132, blade 134, conductor 124, junction point 122, conductor 126, junction point 128, and conductor 130. The third switch P which includes blade 134 is spring loaded and is normally in a closed position. Third switch P opens only when the ball dispenser tray M occupies the second position shown in FIG. 7.

The disk F is formed from a non-light reflecting sheet material, and as a result, beams of light K-1 and K-2 are directed to the first and second light sensitive diodes J-1 and J-2 only when the beams of light K-1, K-2 pass through the apertures T and U to be reflected from the light reflecting surface 90 to the diodes J-1 and J-2. The paths of the light beams K-1 and K-2 are shown in FIG. 11.

When either of the light sensitive diodes J-1 or J-2 becomes conductive due to a beam of light K-1 or K-2 impinging thereon, the solenoid coil 68*a* or 68*b* associated therewith is energized. As the solenoid coil 68*a* or 68*b* are energized, the armature 70*a* or 70*b* associated therewith are pivoted from first positions shown in FIG. 6 to second positions shown in FIG. 7. As one of the armatures 70*a* or 70*b* moves from the first to the second position, the ball stop 78 associated therewith pivots on the pin 80 from the shown in FIG. 6 to the second position shown in FIG. 7, and in so doing n the concave first leg 78*a* thereof releases one of the balls C in contact therewith to roll downwardly towards the second end wall 12*b* housing B. The ball C so released is of sufficient weight and has sufficient momentum that as it contacts the second leg 156 of the ball dispenser M, the ball dispenser is pivoted from the first position shown in FIG. 6 to that illustrated in FIG. 7. As the ball dispenser M so pivots, the blade 118 of second switch O is contacted as illustrated in FIG. 8, where the switch O assuming a closed position to electrically energize the electrically operated alarm N. Operation of the alarm N signals the user of the device to remove one of the balls C from the dispenser M. The dispenser M when relieved of the weight of the ball C resting thereon pivots to the first position shown in FIG. 6 due to the lightly tensioned bearing 168 illustrated in FIG. 9. When the dispenser M pivots from the second position shown in FIG. 7 to the first position illustrated in FIG. 6 the blade 118 of second switch O moves out of engagement with contact 116, and the circuit to the electric alarm N is broken.

Each of the solenoid operated mechanisms L-1 and L-2 is spring loaded by a compressed helical spring 200 of helical configuration with each of these springs extending around one of the armatures 70*a* and 70*b* and disposed between the cross piece 72 and portion 202 of the solenoid operated mechanisms L-1 and L-2. The spring 200, as may be seen in FIG. 6, at all times tends to return the armatures 70*a* and 70*b* from the first position shown in FIG. 2 to the second position illustrated in FIG. 6. After one of the solenoid operated mechanisms L-1 or L-2 has been energized by a beam of light K-1 or K-2 being directed on one of the light sensitive diodes J-1 or J-2, the armatures 70*a* or 70*b* associated with the solenoid mechanism will remain energized so long as a beam of light is directed from the light reflecting surface 90 to the particular appropriate light sensitive diode J-1 or J-2. One aperture in the disk F can only cause actuation of the solenoid mechanism L-1 or L-2 that is responsive thereto for one operation, and with only one of the balls being dispensed to the dispensing mechanism M as a result thereof. When one of the armatures 70*a* or 70*b* moves from the first position shown in FIG. 6 to a second position shown in FIG. 7, the armature 118 of second switch O is moved into engagement with contact 116 to energize the alarm N. The third switch P is normally closed, and as a result, the timer E is energized to slowly rotate the disk F. However, when the dispenser tray M pivots from the first position shown in FIG. 6 to the second position illustrated in FIG. 7, the third switch P is placed in an open position and energization of the timer E is terminated until the ball C on dispenser tray M is removed therefrom. Spring 168 shown in FIG. 9 automatically pivots the dispenser tray M to the first position when a ball C is removed from the latter. Stopping of the timer E until a ball C is removed from the dispenser tray M, precludes a patient taking a medicant B contained in the balls C oftener than the time interval dictated by spacing of the first and second apertures T and U in the disk F.

The cannister V shown in FIG. 12 is filled with the balls C by placing the end wall 40 in an uppermost horizontal position and sequentially placing the balls within the cannister when the door 60 is in the position shown in phantom line in FIG. 12. After the cannister V is filled with balls C, the door 60 is slid to a position to close the opening 58. The cannister V may then be slid downwardly through the opening 30 in top 14 of the housing B, and the door 60 being opened automatically when the canister V is fully disposed within the housing B. The door 60 opens automatically due to tab 62 engaging the shoulder 64, and moving the door upwardly relative to the cannister V.

The balls C previously placed in the cannister V may now by gravity roll downwardly on the ramp defining bottom 42 and be consequentially discharged from the dispensing device A as the solenoid mechanisms L-1 and L-2 are energized by an electric circuit being completed thereto due to beams of light K-1, K-2 being reflected to the light sensitive diodes J-1 and J-2 as previously described.

The use and operation of the invention has been described previously in detail and need not be repeated.

I claim:

1. A device for storing a plurality of hollow balls defined by interlocking half portions that may be manually separated, which balls are consecutively dispensed at desired time intervals, with each of said balls serving as a carrier for a prescribed quantity of a medicant contained therein, which device includes:

a. a cannister in which said balls are stored, in which cannister an opening is formed through which said balls can roll by force of gravity;

b. a housing having a first opening formed therein through which said cannister may be inserted into the interior thereof, and with a second opening being formed in said housing through which said balls may roll due to force of gravity;

c. a spring-loaded ball dispenser tray pivotally supported from said housing that in a first position obstructs said second opening and when in a second position serves as a support for a ball discharged thereonto from said second opening;

d. movable ball stop means in said housing capable of occupying first and second positions, with said ball stop means as it moves from said first to said second position allowing one of said balls to roll from said cannister and pivot said dispenser tray from said first to said second position;

e. first electrically operated spring-loaded means for moving said ball stop means from said first to said second position;

f. an electrically operated timer supported at a fixed on said housing, said timer including a drive shaft;

g. an opaque, non-light reflecting disk having a plurality of circumferentially spaced apertures formed therein, with said disk being non-rotatably mounted on said drive shaft;

h. electrically operated light generating means which emit a beam of light that is sequentially aligned with said apertures as said disk rotates;

i. light sensitive means that becomes electrically conductive only when said beam of light travels through one of said apertures and impinges thereon;

j. a source of electric power;

k. electrically operated sound generating means;

l. a first normally open electrical switch that is closed when said dispenser tray pivots to said second position;

m. a second normally closed electric switch that is opened when said dispenser tray occupies said second position and has one of said balls resting thereon; and n. an electrical circuit connected to said source of power, with said circuit including said first electrically operated means, timer, light-emitting means, light-sensitive means, and said first and second switches, with said first electrically operated means being energized by said electrical circuit each time one of said apertures is aligned with said beam of light to allow the latter to impinge on said light-sensitive means to move said ball stop from said first to said second position and allow one of said balls to pivot said dispenser tray from said first to second position to thereafter rest on said dispenser tray, said first switch when said dispenser tray is in said second position assuming an open position to break said circuit to said timer, which second switch when said dispenser tray is in said second position assumes a closed position to energize said sound-generating means to alert a patient to remove a ball from said dispenser tray, which tray when a ball is removed therefrom pivots to said first position to allow said first and second switches to move to closed and open positions respectively, to energize said timer and terminate operation of said sound-generating means.

2. A device as defined in claim 1 in which said cannister includes:

o. two laterally spaced parallel side walls;

p. a top;

q. a sloping bottom that serves as a ramp;

r. first and second end walls, said second end wall having a third opening therein adjacent said bottom, and a bifurcated portion in said second end wall above said opening; and s. a door slidably movable in said bifurcated portion, which door when in a first position obstructs said third opening to prevent balls within said cannister rolling therefrom.

3. A device as defined in claim 2 in which said cannister in addition includes:

t. a plurality of parallel spaced partitions in said cannister that extend between said sidewalls and terminate above said bottom a distance greater than the external diameter of one of said balls, said partitions cooperating to define a plurality of elongate confined spaces in which a plurality of stacks of said balls are disposed in positions to sequentially move downwardly therein and roll along said bottom to discharge from said third opening when said door is in a second position substantially within said bifuracted portion.

4. A device as defined in claim 3 in which said housing in addition includes:

u. guide and support means within the interior thereof for removably supporting said cannister in a first position therein where said balls may sequentially roll by gravity to said ball stop means to be discharged one by one by said ball stop means onto said dispenser tray as said ball stop means moves from said first to said second position.

5. A device as defined in claim 4 in which said door includes a tab that extends outwardly, therefrom and said housing includes an internal shoulder, with said tab engaging said shoulder and sliding said door to said second position as said cannister is moved downwardly in said housing to said first position.

6. A device as defined in claim 3 in which said movable ball stop means is longitudinally aligned with said stocks of balls and is disposed in said housing between said second and third openings, said ball stop means including:

v. an L-shaped member pivotally supported in said housing that is capable of occupying first and second positions, said member including first and second legs, said first leg when said member is in said first position preventing the one of said balls most adjacent thereto rolling past said member to pivot said dispenser tray from said first to said second position; and w. said first electrically operated spring loaded means connected to said second leg for pivoting said L-shaped member from said first to a second position when said electrically operated means is energized to allow said ball most adjacent said L-shaped member to roll towards said ball dispenser tray to pivot the latter from said first to said second position, with said electrically operated spring loaded means being energized when said light sensitive means becomes electrically conductive due to a beam of light from said light generating means impinging thereon.

7. A device as defined in claim 1 in which said opaque disk is removably mounted in a fixed position on said drive shaft, and said device further including:

o. a transparent disk and a light reflecting disk removably mounted on said drive shaft, with said opaque disk sandwiched therebetween, and said beam of light being reflected to said light sensitive means after said beam has passed through one of said apertures.

* * * * *